US012560060B2

(12) United States Patent
Klatt

(10) Patent No.: US 12,560,060 B2
(45) Date of Patent: Feb. 24, 2026

(54) DOWNHOLE PUMP TOP PLUNGER ADAPTER WITH IMPROVED SAND HANDLING CAPABILITY

(71) Applicant: Tru Lift Supply Inc., Calgary (CA)

(72) Inventor: Ryan Klatt, Calgary (CA)

(73) Assignee: Tru Lift Supply Inc., Calgary (CA)

( * ) Notice: Subject to any disclaimer, the term of this patent is extended or adjusted under 35 U.S.C. 154(b) by 0 days.

(21) Appl. No.: 19/189,515

(22) Filed: Apr. 25, 2025

(65) Prior Publication Data

US 2025/0376918 A1 Dec. 11, 2025

(51) Int. Cl.

*E21B 43/12* (2006.01)
*F04B 47/00* (2006.01)
*F04B 47/02* (2006.01)

(52) U.S. Cl.

CPC ..... *E21B 43/127* (2013.01); *F04B 47/005* (2013.01); *F04B 47/026* (2013.01)

(58) Field of Classification Search

CPC ..... E21B 43/127
See application file for complete search history.

(56) References Cited

U.S. PATENT DOCUMENTS 9,341,183 B1 * 5/2016 Carruth ..... F04B 53/14
2006/0083646 A1 * 4/2006 Ford ..... F04B 53/20 417/555.1
2008/0112826 A1 * 5/2008 Ford ..... F04B 47/026 417/430
2011/0024370 A1 * 2/2011 Ford ..... F04B 47/005 210/512.1
2015/0275869 A1 * 10/2015 Muth ..... F04B 47/005 417/445
2016/0237796 A1 * 8/2016 Stachowiak ..... F04B 47/005
2019/0153830 A1 * 5/2019 Darlington ..... E21B 43/127
2021/0102448 A1 * 4/2021 Fraser ..... E21B 43/127
2023/0048753 A1 * 2/2023 Snyder ..... E21B 43/35

* cited by examiner

*Primary Examiner* — David Carroll

(74) *Attorney, Agent, or Firm* — Kyle R Satterthwaite; Ryan W Dupuis; Ade & Company Inc.

(57) ABSTRACT

An adapter for coupling between a rod and a plunger in a downhole pump has a shaft with an axial through bore, and a cup spanning around a neck portion of the shaft to create an open-topped sand trap annulus between the shaft and cup. Sand trap ports in the shaft wall fluidly communicate the axial through bore and sand trap annulus. A sand trap shoulder on the shaft above the sand trap annulus is flushed clean during the pump downstroke by angled cleanout ports in the shaft wall. The sand trap shoulder is of lesser outer diameter than the cup, whereby the sand trap shoulder denotes a partial sand trap that captures a first fractional portion of sand found in fluid above it, while permitting a second fractional portion of sand to pass downwardly by the sand trap shoulder for capture by the sand trap annulus.

20 Claims, 11 Drawing Sheets

DOWNHOLE PUMP TOP PLUNGER ADAPTER WITH IMPROVED SAND HANDLING CAPABILITY

CROSS-REFERENCE TO RELATED APPLICATIONS

This application claims benefit under 35 U.S.C. 119 (a) of Canadian Patent Application No. 3,237,933, filed May 9, 2024, the entirety of which is incorporated herein by reference.

FIELD OF THE INVENTION

The present invention relates generally to downhole pumps used to produce hydrocarbon containing fluids from a wellbore, and more particularly to componentry used to establish interconnection between a plunger of the downhole pump and a reciprocating rod by which the plunger is reciprocated inside a pump barrel.

BACKGROUND

It is well known in the art to use a downhole pump as a means for artificial lift of oil from a petroleum reservoir, for example to either increase production rates in a naturally producing reservoir or to continue production from a formation at which there is insufficient pressure to naturally produce the fluids to the surface. A downhole pump typically features a pump barrel in which a plunger is slidably disposed. The plunger is attached to the bottom end of a string of sucker rods that depends into the wellbore to couple the plunger to a suitable pumping unit at the surface that drives reciprocation of the string in order to reciprocate the piston or plunger within the pump barrel.

A standing valve resides at a stationary position at a bottom end of the pump barrel, while a travelling valve is carried at the bottom end of the plunger for reciprocal movement therewith within the pump barrel under operation of the at-surface pumping unit. As is commonplace in the art, the terms "top" and "bottom" refer respectively to directionally toward the surface (uphole) and away from the surface, further into the well (downhole), regardless of whether those directions are actually upward and downward (in the vertical sense) in the particular instance or location where movement or relative location of componentry is being described, and thus encompasses both vertical and horizontal wellbores while using the same direction reference terminology (top/up/upper/upward and bottom/down/lower/downward) in either instance.

During the upstroke, drawing the sucker rod string upward (i.e. in the direction of the wellbore leading toward the pumping unit at the surface), the volume between the rising plunger and the standing valve increases, thereby reducing the pressure inside the pump barrel. With a pressure differential introduced across the standing valve, the higher pressure of the reservoir fluid forces this valve open, thereby introducing the fluid into the interior of the pump barrel. During the upstroke, the hydrostatic pressure of fluid present in the production tubing above the pump barrel keeps the travelling valve closed.

During the subsequent downstroke, the effective internal volume of the pump barrel is decreased by the downward displacement of the plunger, thereby increasing the fluid pressure inside the pump barrel. The pressure differential between the interior and exterior of the pump barrel thus reverses, with the higher-pressure fluid inside the pump barrel forcing the standing valve closed, thereby trapping this fluid inside the pump barrel. The rising pressure in the pump barrel increases to a level exceeding the pressure applied to the top side of the travelling valve by the fluid column above the pump barrel, thereby forcing the ball valve of the travelling valve assembly open from the bottom side thereof and allowing the fluid from this bottom side of the travelling valve to pass upwardly therethrough.

A well known challenge in the design of such downhole pumping systems is the accommodation of sandy fluids in which sand particulate are entrained. U.S. Pat. Nos. 7,686,598 and 7,909,589 discloses a downhole pump design particularly designed to address this challenge through incorporation of a sand snare chamber 100 into the downhole pump. With reference to illustration of this prior art in FIG. 1 of the present application, the patented pump 50 has a barrel 60 with a plunger 80 located therein and has standing and traveling valves 70 and 90. The plunger 80 has a first portion 83 having a first seal 84*a* with the barrel 60, and the plunger 80 has a third portion 87 having a second seal 84 *b* with the barrel 60. The first seal 84*a* has resilient members, while the second seal 84*b* is a fluid seal. An opening 81 at the top of the plunger 80 allows lifted fluid to pass up the barrel 60 and the production tubing (not shown) to be produced. In between the first and second portions 83 and 87, the plunger 60 has a second portion 85 that forms a balancing chamber 86 between the barrel 60 and the plunger 80. The plunger's second portion 85 also has an opening 88 to allow communication between the plunger's interior 82 and the balancing chamber 86. A wall 89 is located relative to the opening 88 and forms a sand snare chamber 100 between the balancing chamber 86 and the plunger interior passage 82. To pump fluid from a sandy well, the plunger 80 reciprocates with respect to the barrel 60. Pressure equalizes across the first seals 84*a* by venting pressure from inside of the plunger 82 to outside of the plunger 80 in the balancing chamber 86 between the two seals 84*a* & 84*b*. In the meantime, the pump 50 uses the wall 89 to capture sand from the fluid exiting the opening 88 in the sand snare chamber 100. This collection isolates the sand from the sets of seals 84*a* & 84*b* to reduce wear.

In another prior art solution, a diversion plunger can be used in a rod pump to deal with sandy fluid. FIG. 2A illustrates a typical downhole pump according to the art having a form of diversion plunger. A traveling assembly 150 includes a valve-rod bushing 152, a rod 154, a top connector 156, a plunger 158, a cage 160, a ball valve 162, and a seat 164. A seating assembly includes a cup assembly 112 and a bushing 114, which connects to a stationary assembly having a barrel 116, a cage 118, a ball valve and seat 120, and a barrel-cage bushing 122. For use, the traveling assembly 150 is disposed in the seating and stationary assembly 110 and can reciprocate therein with a rod string connected to the valve-rod bushing 152. The rod 154 extends out of the cup assembly 112, and the plunger 158 with its top connector 156, cage 160, ball valve 162, and seat 164 is movably disposed inside the barrel 116. The barrel 116 disposes in production tubing with a pump seating nipple or other component as conventionally done, and the pump can be used to lift production fluids of a well to the surface as the plunger 158 reciprocates in the barrel 116. The barrel 116 defines an interior in which the plunger 158 is disposed, and the plunger 158 defines an interior as well. The standing valve 120 permits fluid flow from the production tubing (not shown) to flow into the barrel's interior, but restricts fluid flow in the opposite direction. The traveling valve 162 permits fluid flow from the barrel's interior (and especially a variable volume between the valves 162 and 120) to enter the plunger's interior, but restricts fluid flow in the opposite direction.

A gap is formed between the plunger 158 and the barrel 116, and a fluid or hydrodynamic seal that uses the fluid trapped in the gap can hold pressure. The hydrodynamic seal can be formed by long sealing surfaces along the plunger 158 and the barrel 116, which can help deal with sandy fluids. Additionally, the outside surface of the plunger 158 can be hardened with a coating or the like to increase resistance to wear. Typically, the inside surface of the barrel 116 and the outside surface of the plunger 158 have a tight clearance to create the fluid seal. The actual clearance can depend in part on the type of fluid to be encountered, such as heavy or light crude, expected particulate sizes, and other details of the pump. In the rod pumping application, sand can migrate between the barrel 116 and the plunger 158 and can cause damage/scoring to the plunger 158 and/or barrel 116, which eventually leads to poor pumping efficiency and pump failure. To help mitigate damage, the pump 50 can use features of the top connector 156 for the plunger 158. As shown, the top connector 156 is threaded onto the upper end of the plunger 158. The top connector 156 not only connects to the rod 154, but reciprocates with the plunger 158 in the barrel 116 and provides outlets 157 for lifted fluid from the interior 159 of the plunger 158.

FIG. 2B shows an example of a known top connector 200 for a diversion plunger, which would take the place of top connector 156 of FIG. 2A. The top connector 200 includes a body 210 with an open-bottomed internal flow passage 212 therein for communication with a hollow interior 159 of the plunger. A threaded bottom end of the flow passage 212 threads onto an uphole end of the plunger 158, and upper outlet openings 213 of the passage 212 communicate the flow passage 212 and plunger interior 159 to an exterior of the connector 200. The top end 216 of the connector body 210 is also threaded to connect to a rod (e.g., 154 in FIG. 2A). The connector body 210 has a upwardly tapered top edge 218 that is used in mitigating passage of sand past the connector body 210 toward the outside surface of the plunger 158. The threaded connection 214 creates a concentricity issue between the plunger 158 and the connector body 210 and must be machined to a very close tolerance. In fact, to mitigate the travel of sand past the body 210 and its sharp edge 218, the outside surface of the connector body 210 is machined to the diameter of the plunger 158. For this reason, axial alignment of the connector 200 with the plunger 158 is crucial due to 0.002-0.005-in. typical barrel clearance typically used for downhole pumps. Additionally, the connector 200 must be made of a tough, hard material to withstand the operational depths and to resist sand scoring and corrosion. Thus, the connector 200 is restricted to particular types of materials/coatings that can be used because the components must meet particular operational constraints of hardness/toughness for the application.

U.S. Pat. No. 10,731,446 addressed the shortcomings of that prior design with an improved top connector 300 for sandy well conditions, shown in FIG. 3 of the present application. The improved top connector 300 has a mandrel 310 of reduced diameter, relative to the plunger 158, that is attached to the rod 154, and a sleeve 320 is disposed over an exterior of the mandrel 310 in a manner of radially floating relation thereto. In this design, it is the floating sleeve whose external diameter is matched to that of the outside diameter of the plunger, and whose radially floating character relative to the mandrel enables it to stay centralized in the barrel in a self-aligning fashion, and prevents passage of sand from fluid uphole of the sleeve downwardly past the sleeve 320 into the small gap between the plunger 158 and the barrel 116. Upper diversion ports 317 situated above the sleeve 320 fluidly communicate a hollow internal passage 316 of the mandrel to the exterior thereof to accommodate upward travel of fluid from the travelling valve through the plunger and up to the surface. Just below the upper diversion ports 137*a*, the sleeve 320 has a sharp edge 327 of upwardly tapered character to help deflect such sand inwardly toward the mandrel, and thus away from the barrel wall. For additional sand control, another embodiment added wipers disposed around the mandrel below the sleeve, which wipers were accompanied by additional lower diversion ports. Another embodiment instead implemented sleeve-supplementing sand control via inclusion of a screen component between the adapter 300 and the plunger 158.

While thoughtfully designed to alleviate particularly identified shortcomings of the earlier prior art, a notable part count of four separate pieces are involved in assembly of the most basic illustrated embodiment, one whose sand handling capacity is borne entirely by the sleeve alone with no supplemental capacity or failsafe redundancy, and the part count increases even further in embodiments with wipers or a sand screen with additional sand handling capability. Accordingly, there still remains room for improved or alternative designs for plunger adapter componentry with notable sand handling capacity and effectiveness.

SUMMARY OF THE INVENTION

According to a one aspect of the invention, there is provided an adapter for coupling between a rod and a plunger in a downhole pump system, said adapter comprising:

- a shaft having an axial through-bore passing axially therethrough from a top end of the shaft to an opposing bottom end thereof, and being configured at an upper coupling portion for coupled attachment to a first component of the downhole pump system of uphole relation to the adapter;
- a cup having a chambered upper portion spanning circumferentially around the shaft at a neck portion thereof that resides below said upper coupling portion and inside a hollow upper chamber of the chambered upper portion of the cup, said hollow upper chamber being open at a top end of the cup and having an internal diameter that exceeds an external diameter of the neck portion of the shaft, thereby leaving an open sand trap annulus between the shaft and the cup at the chambered upper portion thereof;
- one or more sand trap ports penetrating a peripheral wall of the shaft at the neck portion thereof and thereby fluidly communicating the axial through-bore of the shaft with the open sand trap annulus between the shaft and the cup at chambered upper portion thereof;
- a sand trap shoulder provided on the shaft at a location thereon above both the neck portion of the shaft and the upper chambered portion of the cup, said sand trap shoulder spanning circumferentially around the shaft and imparting a localized increase of external diameter to the shaft relative to neighbouring areas thereof immediately above and below the sand trap shoulder to hinder passage of sand, situated outside the shaft, from above the sand strap shoulder downwardly therepast toward the plunger; and
- angled cleanout ports penetrating an exterior of the peripheral wall of the shaft just above the sand trap shoulder and penetrating an interior of the peripheral wall, into the axial through bore of the shaft, at lesser elevation thereon than where the angled cleanout ports penetrate the exterior of the exterior of the peripheral wall, said angled cleanout ports being operable to flush clean the sand trap shoulder during a downstroke of the downhole pump system;

wherein an outer diameter of the sand trap shoulder of the shaft is less than an outer diameter of the cup so that the sand trap shoulder denotes a partial sand trap effective to capture a first fractional portion of said sand, while permitting a second fractional portion of said sand to pass downwardly past the sand trap shoulder to the cup, where the second fractional portion of said sand capturable by the sand trap annulus at the chambered upper portion of the cup, whereby the sand trap and the cup cooperatively inhibit downward passage of sand to the plunger.

BRIEF DESCRIPTION OF THE DRAWINGS

Preferred embodiments of the invention will now be described in conjunction with the accompanying drawings in which.

DETAILED DESCRIPTION

Figure 1:
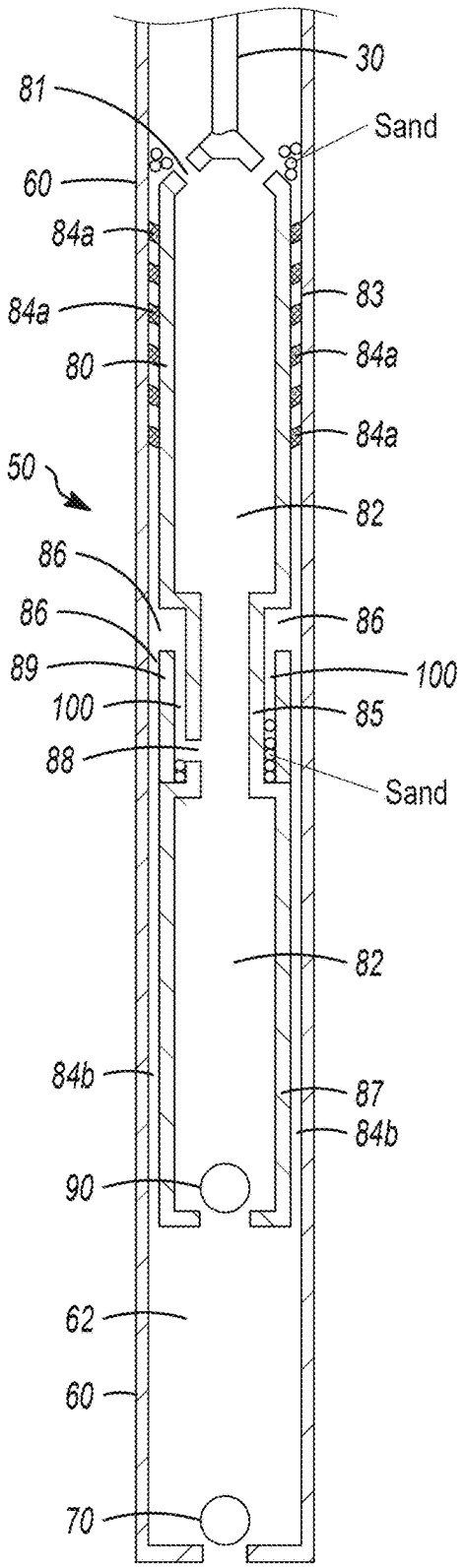
FIG. 1 (PRIOR ART)
FIG. 1 illustrates a downhole pump of the prior art that is equipped with a sand snare chamber.
Figure 2A:
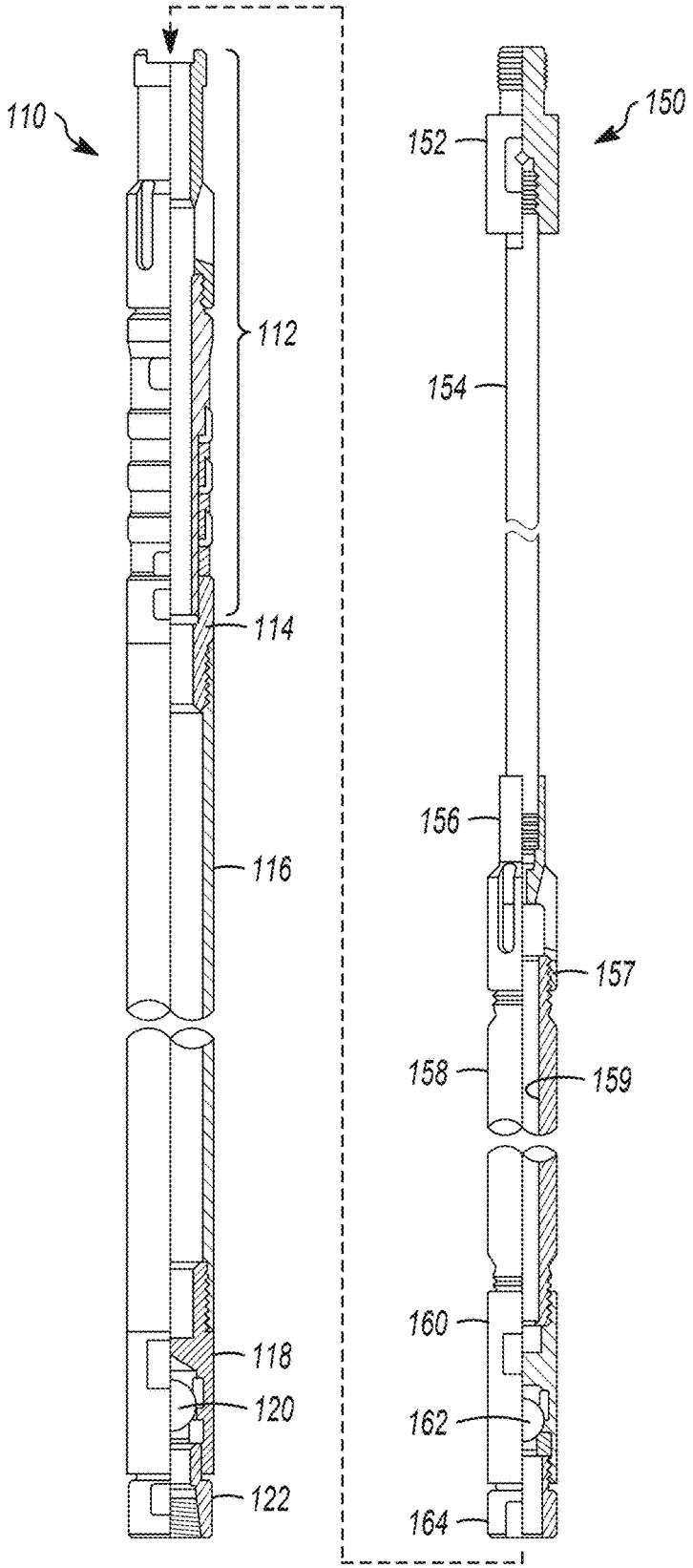
FIG. 2A (PRIOR ART)
FIG. 2A illustrates a different downhole pump of the prior art.
Figure 2B:
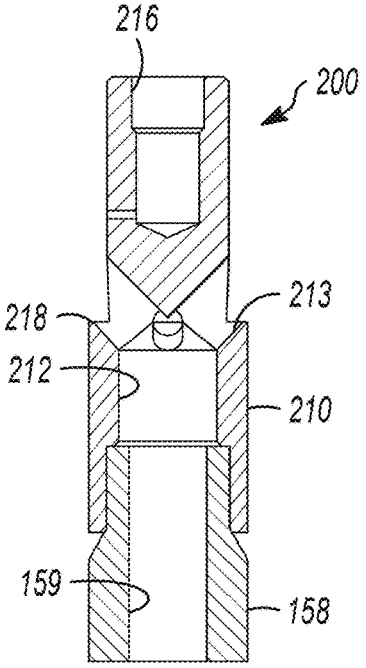
FIG. 2B (PRIOR ART)
FIG. 2B illustrates a top plunger adapter of the prior art for use in a downhole pump of the type shown in FIG. 2A.
Figure 3:
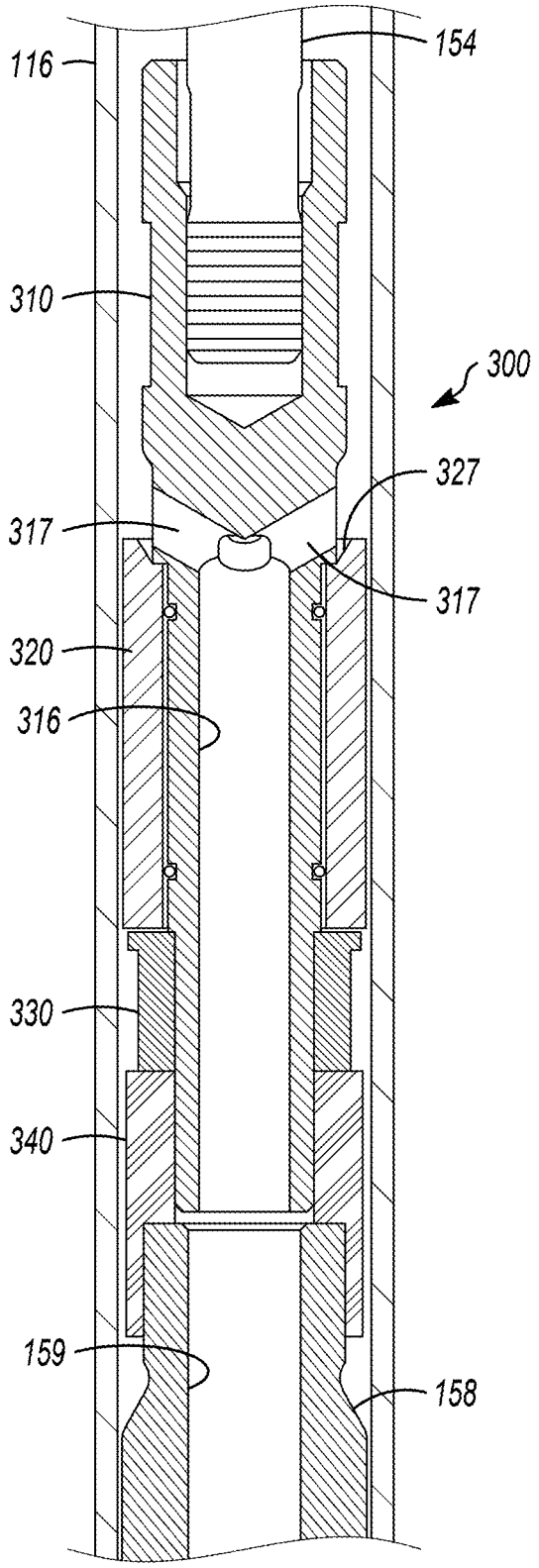
FIG. 3 (PRIOR ART)
FIG. 3 illustrates an improved top plunger adapter of the prior art usable in place of that of FIG. 2, and equipped with a radially floating sleeve.
Figure 4A:
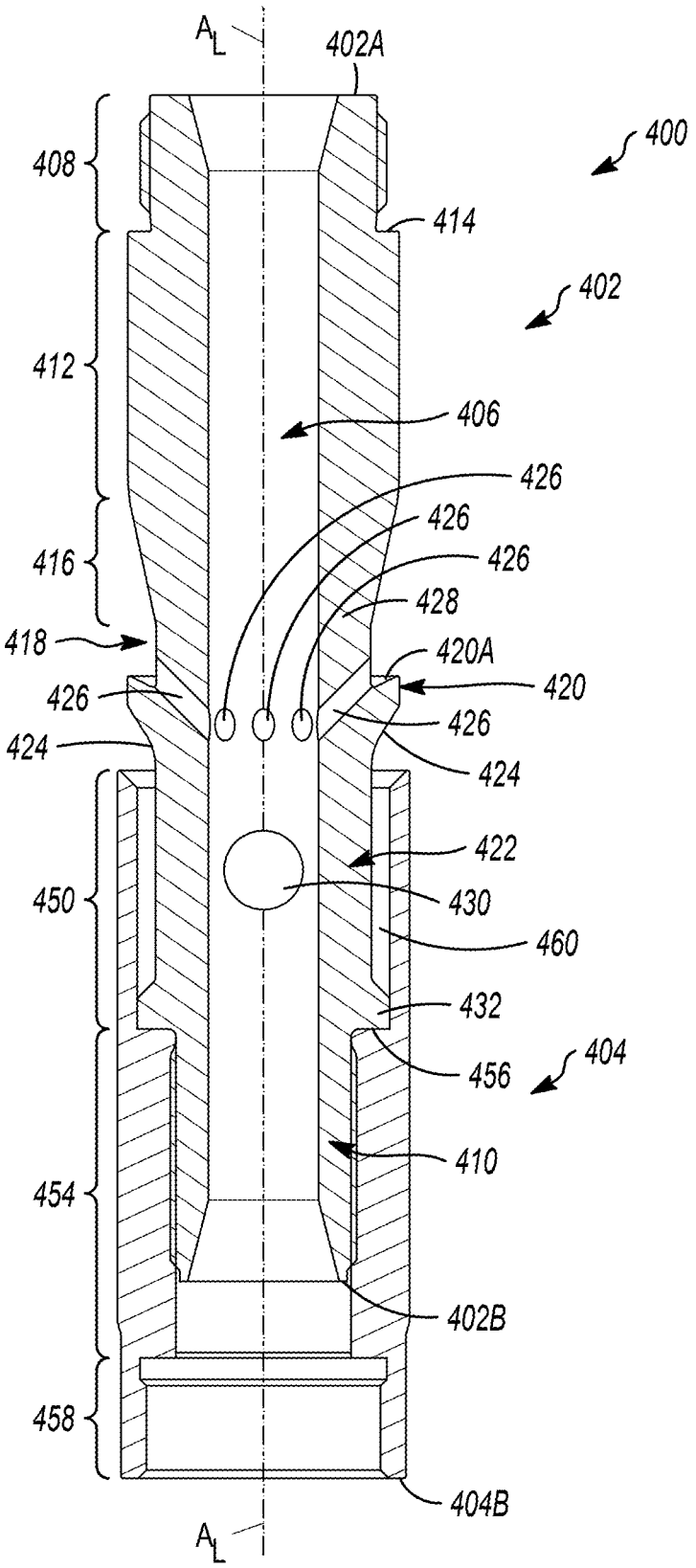
FIG. 4A is an assembled cross-sectional view of a top plunger conversion adapter of the present invention.
Figure 4B:
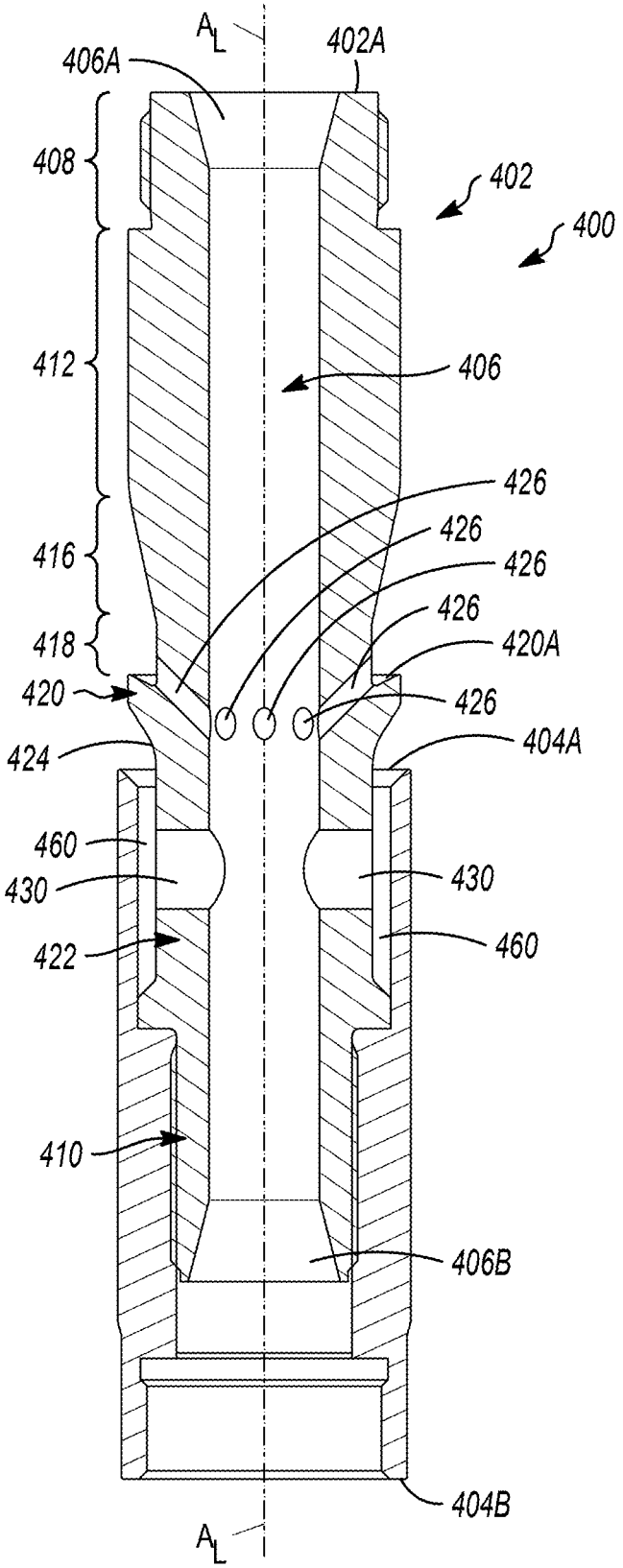
FIG. 4B is another assembled cross-sectional view of the top plunger conversion adapter of FIG. 4A, in a different cross-sectional plane offset 90-degrees therefrom.
Figure 5:
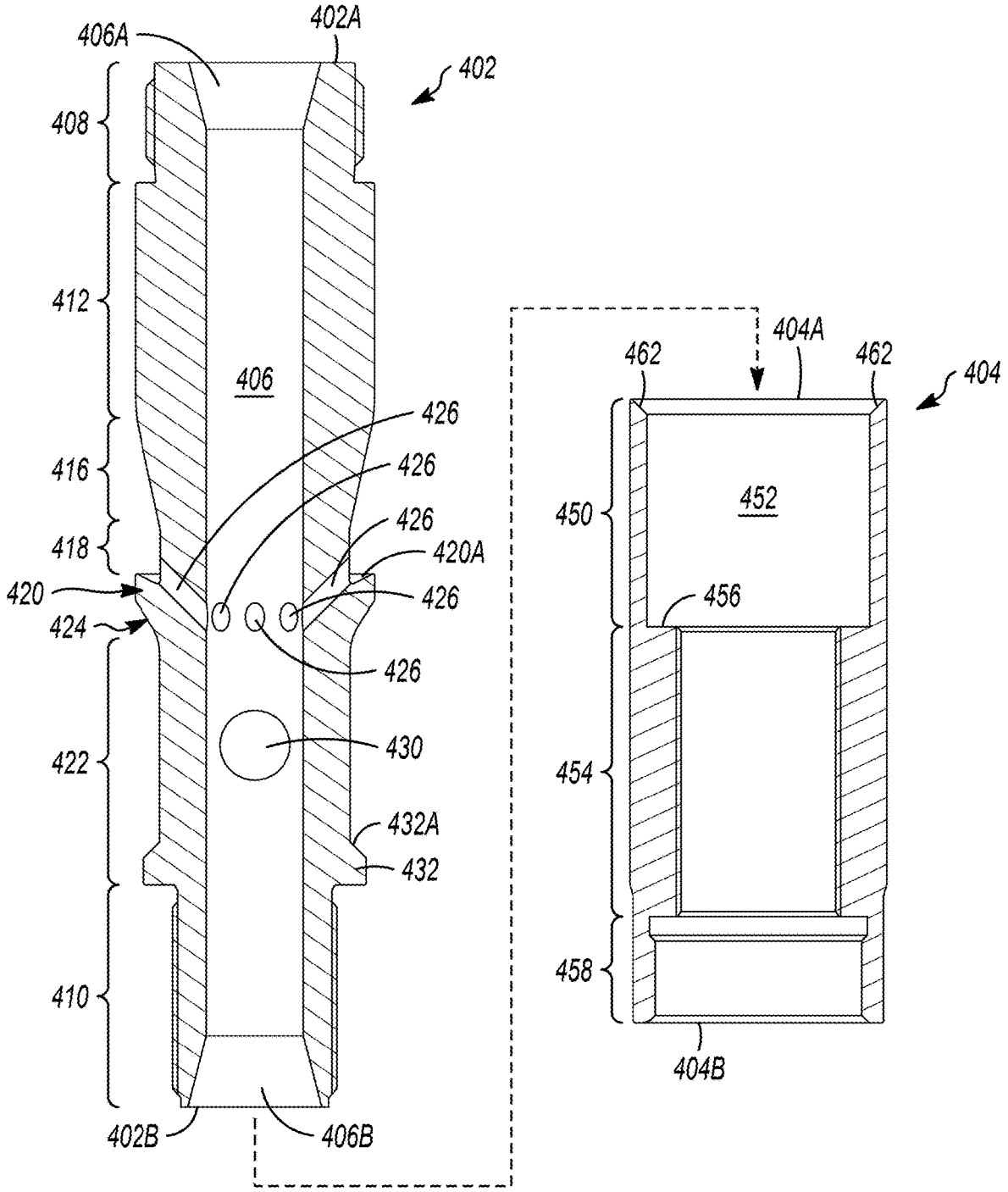
FIG. 5 is a cross-sectional exploded view of the top plunger conversion adapter of FIG. 4.
Figure 9:
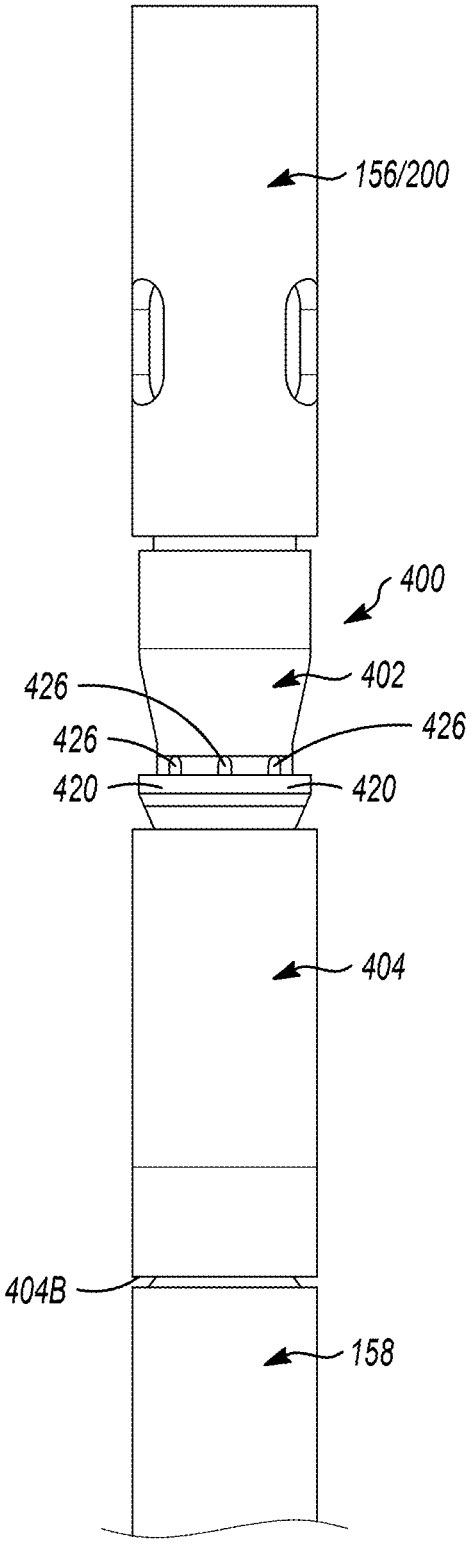
FIG. 9 illustrates the top plunger conversion adapter of FIGS. 4 and 5 assembled with a conventional top connector and plunger in an installed state of the top plunger conversion adapter, ready for use.

FIGS. 4A, 4B and 5 illustrate one embodiment of a novel top plunger conversion adapter 400 of the present invention that is installable, for example, between the top connector 156 and plunger 158 of the downhole pump of FIG. 2A, or between the alternative top connector 200 of FIG. 2B, if substituted for that of FIG. 2A, and the plunger 158. The top plunger conversion adapter 400 is designed to improve the downhole pump's ability to handle sand-laden fluids, but with a lesser part count than the sleeve-equipped prior art top connector 300 of FIG. 3. The present embodiment is referred to as a top plunger "conversion" adapter 400 because it is installed as an added conversion adapter to an existing top connector, such as that shown at 156 or 200 of FIG. 2A or 2B, to "convert" it into a sand capable top connector, instead of as a substitutable replacement of such existing top connector, like the prior art top connector 300 of FIG. 3. That said, in other embodiments, the inventive adapter 400 may alternatively incorporate the functional features of a top connector 156, 200 directly in the adapter 400, in which case the inventive adapter 400 may be employed as a substitute for, rather than an additional to, an existing top connector 156, 200, as shown in FIG. 9. Therefore, the inventive adapter 400 may be referred to herein generically as an adapter or top plunger adapter, regardless of whether it is installed in substitution for a top connector, or as a supplemental add-on thereto.

The present embodiment of the inventive adapter 400 is a two-piece assembly, of which the first piece is referred to as a shaft component 402 (or simply a "shaft", for brevity), and the second piece is referred to as a cup component 404 (or simply a "cup", for brevity). The shaft 402 has a top end 402A and an opposing bottom end 402B, and an axial through-bore 406 passing axially through an entirety of the shaft 402 from the top end 402A thereof to the opposing bottom end 402B. An uppermost coupling portion 408 of the shaft 402 adjacent the top end 402A thereof is configured as an externally threaded male pin connection for threaded mating with an internally threaded female box connection at the bottom end of the top connector 156 or 200, where the plunger 158 would have conventionally been threadingly coupled directly to this top connector 156 or 200. A lowermost coupling portion 410 of the shaft 402 adjacent the bottom end 402B thereof is also externally threaded for threaded mating with an internally threaded portion of the cup 404, as described in more detail further below. The lowermost coupling portion 410 is of lesser outer diameter than the uppermost coupling portion 408.

Immediately below the uppermost coupling portion 408 of the shaft 402, is a wide portion 412 thereof of greater outer diameter than the uppermost coupling portion 408 above it. The wide portion 412 is characterised by an annular stop shoulder 414 at its top end, attributed to the change in diameter from the smaller uppermost coupling portion 408 to the wide portion 412, which stop shoulder 414 abuts up against a bottom end of the top connector 156 or 200 when coupled thereto by threaded engagement of the shaft's uppermost coupling portion 408 therewith. Though not shown in the drawings, this wide portion 412 may feature opposing wrench flats thereon to enable tool aided rotation of the shaft 402 during assembly of the adapter 400, and during threaded coupling of the assembled adapter 400 to the top connector 156 or 200 at the uppermost coupling portion 408 of the shaft 402. Below the wide portion 412, the shaft 402 has a downwardly tapered portion 416 at which the external diameter of the shaft 402 gradually reduces moving axially downward therealong, before regaining uniformity of diameter and an axially adjacent over-shoulder portion 418 of the shaft 402.

This over-shoulder portion 418 of the shaft 402 is referred to as such because it is immediately neighboured therebelow by a sand trap shoulder 420 that spans circumferentially around the shaft 402 and imparts a localized increase of external diameter to the shaft 402 relative to both the over-shoulder portion 418 situated above the sand trap shoulder 420 and a neck portion 422 of the shaft 402 residing below the sand trap shoulder 420. A topside 420A of the sand trap shoulder 420 is beveled, having an upwardly inclined slope toward the outer circumference of the sand strap shoulder 414. The outer diameter of the sand strap shoulder 420 may equal to that of the wide portion 412 of the shaft 402. The neck portion 422 and the sand trap shoulder 420 are joined via a flared transition 424 of upwardly flared profile that provides a gradual widening of the shaft 402 from the neck portion 422 to the sand trap shoulder 420, and which flared transition is concavely contoured in the illustrated embodiment.

A plurality of angled cleanout ports 426 are provided in cooperative relation to the sand trap shoulder 420, and fluidly communicate the axial through-bore 406 of the shaft 402 to the exterior thereof by penetrating through a peripheral wall 428 of the shaft 402 that circumferentially surrounds, and thereby delimits, the axial through-bore 406 thereof. Each angled cleanout port 426 penetrates the exterior of the peripheral wall 428 of the shaft 402 just above the sand trap shoulder 420, and penetrates an interior of the peripheral wall 428, into the axial through bore 406 of the shaft 402, at a lesser elevation thereon than where the angled cleanout port 426 penetrates the exterior peripheral wall 428. Each angled cleanout port 426, for example, penetrates the interior of the peripheral wall 428 at an elevation equal to, or proximate, that of the bottom of the sand trap shoulder 420 or the flared transition 424. The angled character of cleanout ports 426 thus refers to an upwardly sloped inclination of each thereof in a radially outward direction from the axial through-bore 406.

Further down the shaft 402 at the neck portion 422 thereof, one or more sand trap ports 430, of which there are two in the illustrated example, also penetrate through the peripheral wall 428 of the shaft 402 from the axial through bore 406 of the shaft 402 to the exterior thereof. These sand trap ports 430 are individually larger than the comparably small cleanout ports 426 at the sand trap shoulder 420, but are provided in lesser quantity than the comparably small cleanout ports 426, and therefore occupy positions of less densely spaced distribution around the circumference of the shaft. In the illustrated case of two such sand trap ports 430, they are distributed at equal 180-degree intervals around the shaft 402, whereas the illustrated embodiment has eight angled cleanout ports 426 distributed at equal 45-degree intervals around the shaft 402, denoting a more densely distributed layout in the circumferential direction around the shaft.

In the present embodiment, the bottom end of the neck portion 422 of the shaft 402 is characterized by an external abutment shoulder 432 of greater outer diameter than the remainder of the neck portion 422 above this external abutment shoulder, but of lesser outer diameter than the sand trap shoulder 420. The purpose of this abutment shoulder 432 is to establish a fully mated position of the shaft 402 in its threaded coupling to the cup 404, where the external abutment shoulder 432 of the shaft 402 will abut against a corresponding internal stop shoulder of the cup 404 in the manner illustrated in FIGS. 4A and 4B, and described in more detail further below. In the illustrated example, the axial through bore 406 of the shaft 402 is downwardly tapered at a top region 406A of the through bore 406 that resides adjacent the top end 402A of the shaft 402, and is upwardly tapered at a bottom region 406B of the through bore 406 that resides adjacent the bottom end 402B of the shaft 402.

Having fully described the geometry of the shaft 402, attention is now turned to the geometry of the cup 404, and the relationship between these two components 402, 404 in the assembled state of the novel adapter 400. The cup 404 has a top end 404A and an opposing bottom end 404B, the two of which lie oppositely of one another in an axial direction matching that in which the top and bottom ends 402A, 402B of the shaft 402 are of likewise opposing relation to one another. This axial direction is denoted in the drawings by a central longitudinal axis $A_L$ on which the shaft 402 and cup 404 are both centered in the assembled state of the adapter 400. The cup 404 features a chambered upper portion 450 having a hollow upper chamber 452 that is cylindrical in shape and fully open at the top end 404A of the cup 404. The diameter of the upper chamber 452, denoting the internal diameter of the chambered upper portion 450 of the cup 404, is larger than the external diameter of the neck portion 422 of the shaft 402. This enables receipt of the neck portion 422 of the shaft 402 into the hollow upper chamber 452 of the cup 404 in the assembled state of the adapter 400, as shown in FIGS. 4A and 4B.

Below the chambered upper portion 450, the cup 404 features an internally threaded middle portion 454 of lesser inside diameter than the chambered portion 450. The internal female threading of this threaded middle portion 454 of the cup is matable with the external male threading of the externally threaded lowermost coupling portion 410 of the shaft 402, via insertion of the threaded lowermost coupling portion 410 of the shaft 402 through the open top end 404A and hollow upper chamber 452 of the cup 404 into the threaded middle portion 454 thereof. Owing to this difference in diameter between the chambered upper portion 450 and threaded middle portion 454, the cup 404 features an internal stop shoulder 456 at the bottom end of the hollow upper chamber 452. It is against this internal stop shoulder 456 that the external abutment shoulder 432 of the shaft 402 bottoms out when the shaft 402 and the cup 404 are threaded together into a fully mated state, thereby denoting the fully assembled state of the adapter, as shown in FIGS. 4A and 4B. Below the threaded middle portion 454, the cup 404 features a plunger coupling portion 458, which is another hollow female portion, like the chambered upper portion and threaded middle portion above it, so that the hollow interiors of the three portions of the cup cooperatively span a full axial length of the cup from the open top end 404A thereof to the open bottom end 404B thereof. In the illustrated example, the plunger coupling portion 458 is configured as an internally threaded female box connection of greater internal diameter than the threaded middle portion 454, and is thereby directly matable with a plunger whose top end is configured with an externally threaded male pin connection, such as the conventional plunger 158 shown in any of FIGS. 2A, 2B, 3 and 9. The plunger coupling portion 458 may alternatively be configured as an externally threaded hollow male pin connection for mating with a plunger whose top end is instead configured with an internally threaded female box connection.

Figure 8A:
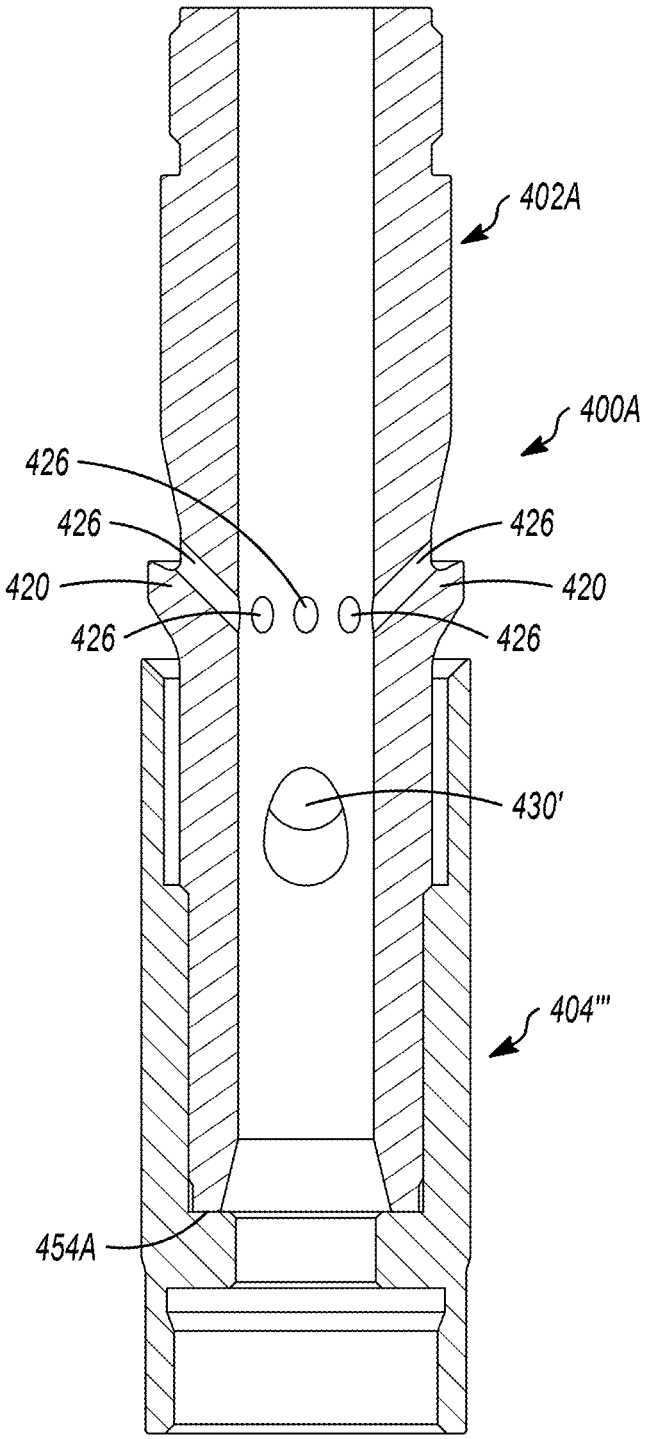
FIG. 8A illustrates another variant of the top plunger conversion adapter of FIGS. 4 and 5, again in the same cross-sectional plane as FIG. 4A.
Figure 8B:
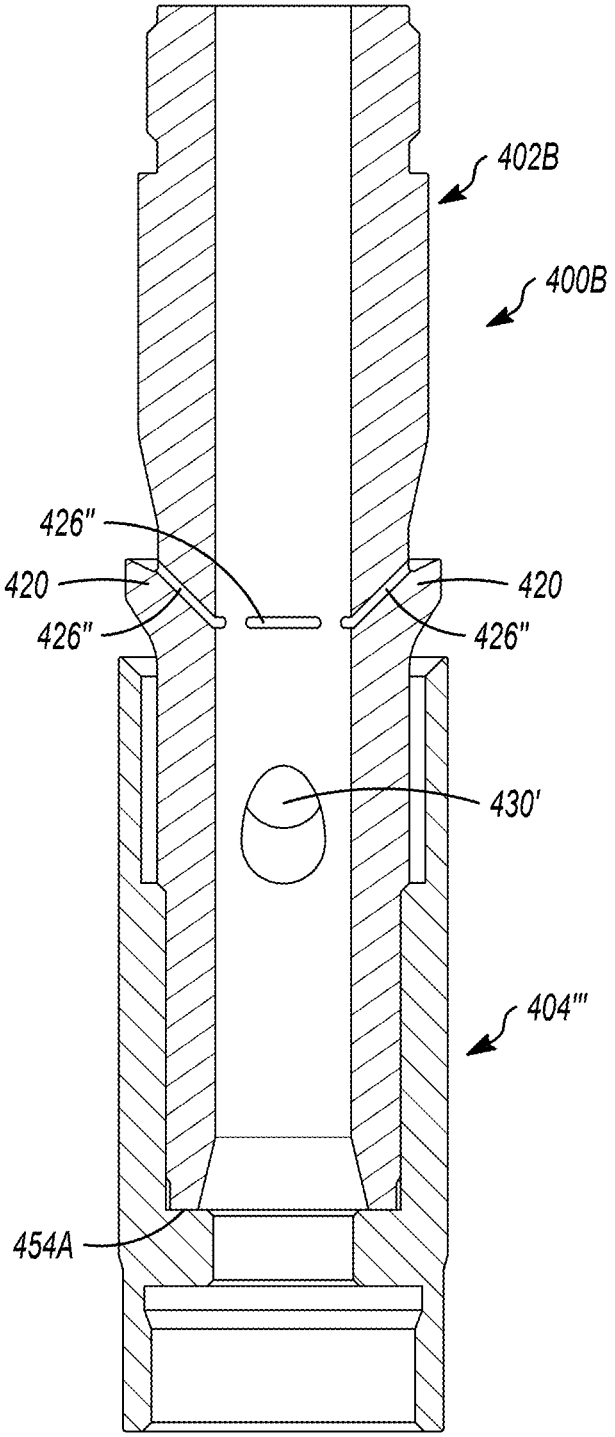
FIG. 8B illustrates a further variant of the top plunger conversion adapter of FIG. 8A, in the same cross plane.

It will be appreciated that instead bottoming out of an external abutment shoulder 432 on the shaft with an internally shouldered bottom of the hollow upper cavity 452 of the cup 404, the cup may feature an internal stop shoulder at the bottom of its threaded middle section 454, at shown at 454A of the cup 404" in the variant adapters 400A, 400B of FIGS. 8A and 8B, for abutment thereof by the bottom end 402B of the shaft 402, in which case the shaft 402A, 402B may optionally omit the external abutment shoulder 432 at the bottom end of the neck portion 422, as likewise shown in FIGS. 8A and 8B. Among FIGS. 8A and 8B, FIG. 8B shows how the angled cleanout ports 426" need not be circular, oval-shaped or otherwise rounded in their cross-sectional shape, and for example could be slot-shaped in cross-section, with a slot-shaped profile that is notably narrower in the axial direction of the adapter than it is wide in the circumferential direction of the adapter. The narrow slot-shaped flow ports 426 could impart a more jet-like and effective cleanout action than the round holes of the other embodiments that of closer (if not equal) measure in the axial and circumferential directions.

In the illustrated example, the cup 404 is externally *cylindrica* throughout its fully axial length, thus maintaining a uniform external diameter from the top end 404A of the cup to the opposing bottom end 404B thereof. This external diameter of the cup 404 denotes the maximum external diameter of the overall assembled adapter 400, whereby it is the cup 404 of the adapter 400 that is designed to reside in close proximity to the inside of the pump barrel 116 to achieve a fluid or hydrodynamic seal therewith.

The inside diameter of the hollow upper chamber 452 of the cup 404 intentionally exceeds the external diameter of the neck portion 422 of the shaft 402, the purpose of which is leave an open annular gap between the shaft 402 and the cup 404 at the chambered upper portion 450 of the cup, which annular gap is also referred to herein as a sand trap annulus 460 of the adapter 400. The top annular rim of the cup 404 at the top end 404A thereof is a beveled edge 462, which like the beveled topside 420A of the shaft's sand trap shoulder 420, is angulated at a slope of upward inclination in radially outward relation from the central longitudinal axis $A_L$. In the assembled state of the adapter 400, with the lowermost coupling portion 410 of the shaft 402 threaded into the internally threaded middle portion 454 of the cup 404, the neck portion 422 of the shaft 402 and the sand trap ports 430 therein reside inside the hollow upper chamber 452 of the cup 404.

The shaft's sand trap shoulder 420 instead resides externally of the cup 404 in elevated relation above the open top end 404A and beveled top rim 462 of the cup 404. The sand trap shoulder 420 is intentionally of lesser external diameter of the cup 404 to leave flow clearance between the sand trap shoulder 420 and the pump barrel 116 to permit some amount of fluid found above the sand trap shoulder 420, and any sand contained in that fluid, to pass downwardly by the sand trap shoulder 420 to the preferably beveled top end 404A of the cup. At the same time, because the sand trap shoulder 420 is of greater exterior diameter than the over-shoulder portion 418 of the shaft 402 above the sand trap shoulder 420, a fractional portion of any such sand in the fluid above the sand trap shoulder can be captured atop the sand trap shoulder 420 and/or diverted into the internal through bore 406 of the shaft 402, and thus prevented from reaching either the cup 404 or the plunger 158 coupled to the bottom end 404B of the cup 404. Such capturing or diversion of a fractional portion of the sand by the cup-overlying sand trap shoulder 420 is made more effective by the preferably beveled character of the topside 420A of the sand trap shoulder 420, which encourages the sand radially inward, and thus away from the pump barrel 116.

At the same time, because the sand trap shoulder 420 is intentionally smaller in external diameter than the cup 404, another fractional portion of the sand-carrying fluid above the sand trap shoulder 420 is intentionally permitted to pass downwardly by the sand trap shoulder 420 and onward to the preferably beveled top edge 462 of the cup 404, where this sand gets captured in the sand trap annulus 460 between the shaft 402 and the cup 404. The preferably beveled character of the top edge 462 of the cup 404, like the preferably beveled topside 420A of the sand trap shoulder 420, helps direct radially inward movement of the sand that bypassed the sand trap shoulder 420, thus directing such sand away from the wall of the pump barrel 116 and into the sand trap annulus 460 between the shaft 402 and the cup 404. Such collection of sand by the sand trap shoulder 420 and the sand trap annulus 460 typically occurs during the upstroke of the pump, and at times when the pump is stationary, during which sand can gravitationally settle out of the fluid situated above the sand trap shoulder 420.

Between the top end 404A of the cup 404 and the sand trap shoulder 420 of the shaft, the adapter is completely void of any wipers or other means for making sealed sliding contact with the pump barrel wall, thus permitting uninhibited admission of the second fraction of sand into the open sand trap annulus between the neck portion of the shaft and the chambered upper portion of the cup. This, and the intentionally undersized character of the sand trap shoulder 420 relative to the external diameter of the cup 404 and the plunger 158 to specifically and intentionally permit a degree of sand passage downwardly therepast, runs contradictory of the prior art, where conventional thinking has been that in order to better prevent sand from reaching the plunger, the solution is the addition of wipers or other such sealing means to increase the overall quantity of sealed pump barrel contact above the plunger.

During the downstroke of the downhole pump, fluid moving upward through the travelling valve travels up through the interior 159 of the plunger 158, and into the axial through bore 406 of the shaft 402 of the adapter 400, as permitted by the fluidically communicated relationship between the hollow interiors of the plunger coupling portion 458 of the cup 404 and the threaded middle portion 454 thereof, inside of the latter of which the open bottom end 402B of the shaft 402 resides in the adapter's assembled state. A fraction of this fluid moving upwardly through the axial through bore 406 of the shaft 402 is discharged therefrom through the sand strap ports 430 into the sand trap annulus 460 between the shaft 402 and the cup 404 at the chambered upper portion 450 thereof, thus helping flush out any sand that has accumulated in this sand trap annulus 460 and its flow ports 430. Likewise, a fraction of the fluid that passes onwardly up the axial through bore 406 of the shaft 402 past the sand strap ports 430 thereof during the downstroke of the pump is discharged from the shaft's axial through bore 406 through the angled cleanout ports 426 at the sand trap shoulder 420, to flush away any sand buildup that has accumulated at the sand trap shoulder 420 and its cleanout ports 426. During the upstroke of the pump, the relatively large sand trap ports 430 serve to draw sand toward or into into the axial through bore 406 owing to creation of a low pressure vacuum effect therein during the upstroke.

The sand trap shoulder 420, with its exterior diameter being less than that of the cup 404, denotes a partial sand trap effective to capture a first fractional portion of the sand while permitting a second fractional portion of said sand to pass downwardly beyond the sand trap shoulder to the cup, where the second fractional portion of said sand is instead captured by sand trap annulus 460 cooperatively formed by the shaft 402 and the cup 404. The sand trap and the cup thus cooperatively inhibit or prevent downward passage of sand to the plunger. Should one sand trap become overly clogged to the point it can't be flushed clean during the downstroke, a degree of sand handling capability is nonetheless retained by the other unclogged sand trap. By distributing the sand handling functionality of the adapter 400 between the sand trap annulus 460 and the additional shaft-carried sand trap shoulder 420, beneficial results are seen in terms of the overall sand handling capacity, minimization of a total sand plugging risk and inclusion failsafe redundancy should either one trap individually become irreversibly plugged, all of which is achieved in a relatively simple assembly having only two component parts.

Figure 6:
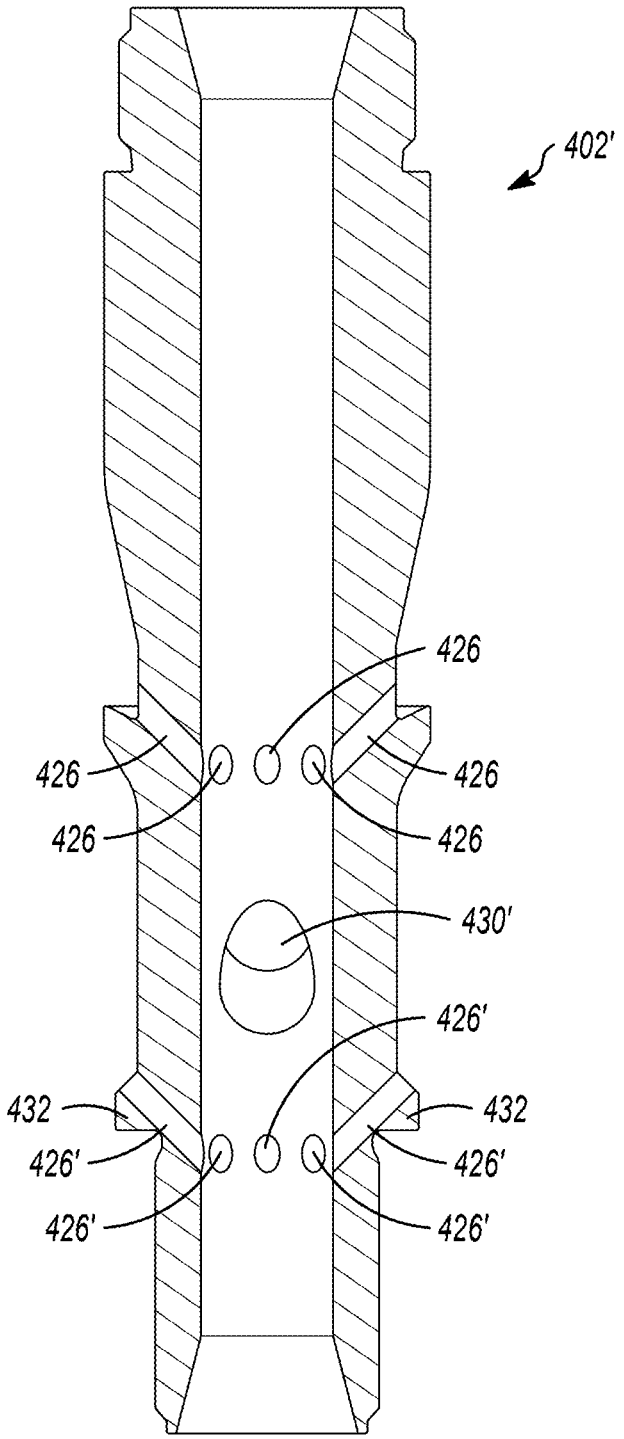
FIG. 6 is a cross-sectional view, in same plane as FIG. 4A, of a modified shaft component for a variant of the top plunger conversion adapter of FIGS. 4 and 5.

FIG. 6 illustrates a modified form of the shaft 402' in which a set of additional angled cleanout ports 426', of the same type found at the sand trap shoulder 420, are included at the abutment shoulder 432 at the bottom end of the shaft's neck portion 422, the purpose of which is to improve the self-flushing cleanout of the sand trap annulus 460 between the shaft 402 and the cup 404 at the chambered upper portion 450 thereof. The additional angled cleanout ports 426' penetrate the exterior of the peripheral wall 428 of the shaft 402 inside the hollow upper chamber 452 of the cup 404, at or near the bottom end of the sand trap annulus 460, which in the illustrated example is denoted by a beveled topside 432A of the abutment shoulder 432. The beveled topside 432A of the abutment shoulder 432 is of downwardly declined slope in the radially outward direction, in opposition to the outwardly inclined slope direction of the beveled topside 420A of the sand trap shoulder 420 and the beveled top rim 462 of the cup 404. The additional angled cleanout ports 426' penetrate the interior of the peripheral wall 428 of the shaft 402 at a lower elevation than where they penetrate the exterior thereof, for example penetrating the interior of the peripheral wall 428 at an upper region of the lowermost coupling portion 410 of the shaft 402. The shaft variant 402' of FIG. 6 also differs from the earlier example in that the sand trap ports 430' are given an upwardly inclined orientation, like those of the smaller angled cleanout ports 426, 426' to impart an upward directionality to the fluid used to flush out the sand trap annulus 460 during the downstroke of the pump.

Figure 7A:
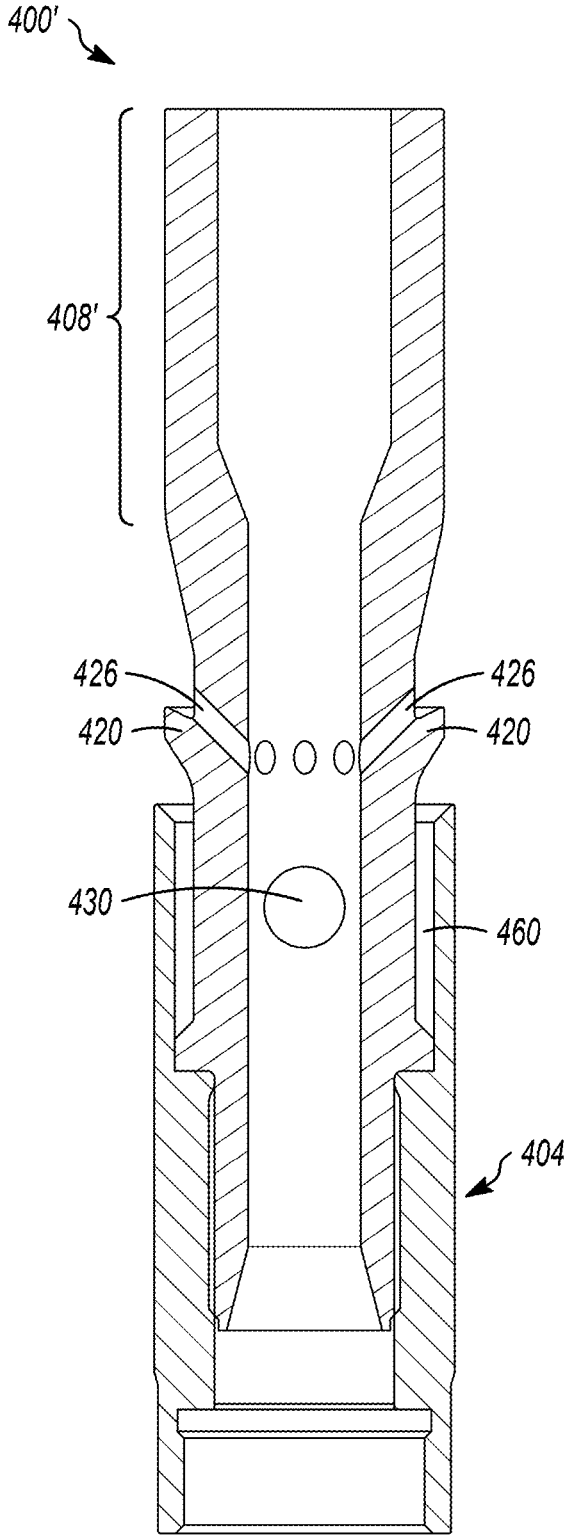
FIGS. 7A and 7B illustrate additional variants of the top plunger conversion adapter of FIGS. 4 and 5, again in the same cross-sectional plane as FIG. 4A.
Figure 7B:
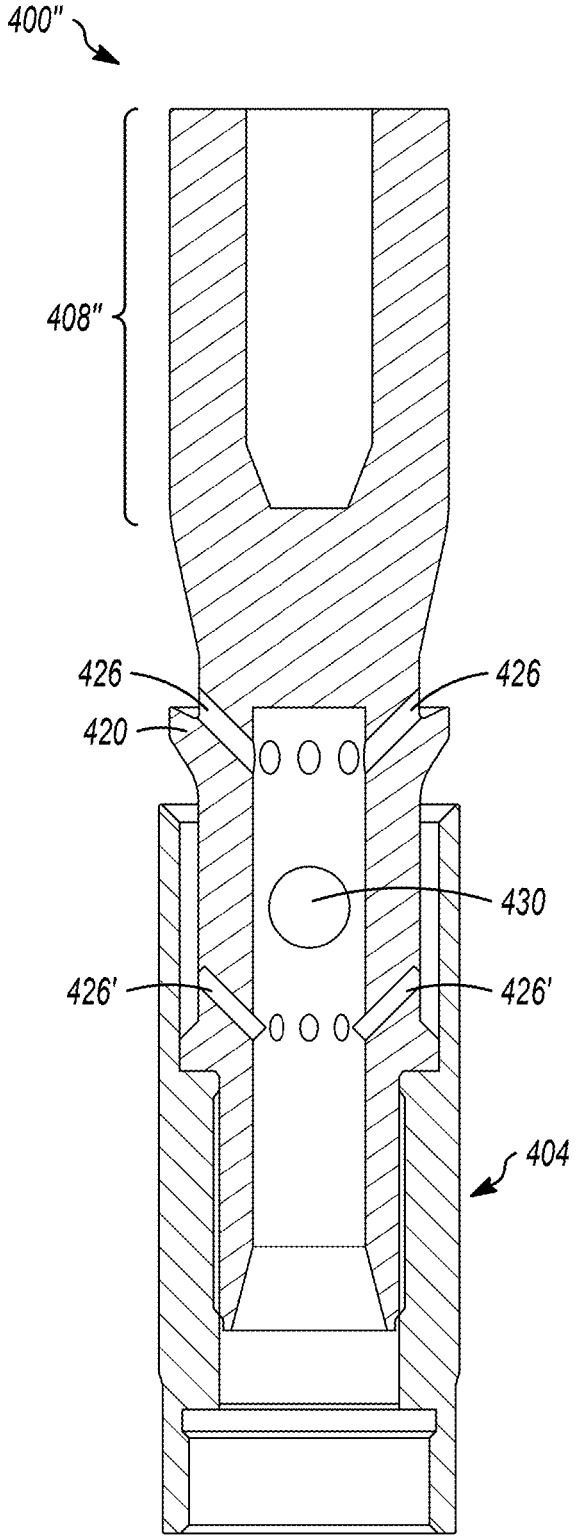

FIG. 7A illustrates a variant 400' of the adapter 400 in which the shaft 402 of FIGS. 4A, 4B and 5 has been modified to reconfigure the uppermost coupling portion 408' of the shaft 402 as an internally threaded female box connection to enable direct coupling of the shaft 402 to the rod 154 of the downhole pump, instead of indirect coupling thereto through a top connector, such as 156 or 200. In this variant 400', the sand trap ports 430 and the angled cleanout ports 426 define the ultimate outlets by which the fluid travelling up through the plunger from the travelling valve ultimately exits the travelling assembly 150, instead of through outlet openings 213 in the top connector 156 or 200. FIG. 7B illustrates a similar variant 400" in which the uppermost coupling portion 408" of the shaft 402' of FIG. 6 has likewise been reconfigured as an internally threaded female box connection, and illustrates how the shaft need not have a full-length axial through bore spanning all the way to the top end 402A of the shaft in either variant of FIG. 7, as illustrated by a solid interior of the downwardly tapered portion 416" in the FIG. 7B variant. In this variant, it is the sand trap ports 430 and the two sets of angled cleanout ports 426, 426' that form the ultimate outlets of the travelling valve assembly 150. The FIG. 7B variant also illustrates how the second set of angled cleanout ports 426' need not necessarily reside directly at the bottom of the sand trap annulus 460, and need not necessarily penetrate through a top-beveled external abutment shoulder 432 of the shaft.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. An adapter for coupling between a rod and a plunger in a downhole pump system, said adapter comprising:

a shaft having an axial through-bore passing axially therethrough from a top end of the shaft to an opposing bottom end thereof, and being configured at an upper coupling portion for coupled attachment to a first component of the downhole pump system of uphole relation to the adapter;

a cup having a chambered upper portion spanning circumferentially around the shaft at a neck portion thereof that resides below said upper coupling portion and inside a hollow upper chamber of the chambered upper portion of the cup, said hollow upper chamber being open at a top end of the cup and having an internal diameter that exceeds an external diameter of the neck portion of the shaft, thereby leaving an open sand trap annulus between the shaft and the cup at the chambered upper portion thereof;

one or more sand trap ports penetrating a peripheral wall of the shaft at the neck portion thereof and thereby fluidly communicating the axial through-bore of the shaft with the open sand trap annulus between the shaft and the cup at chambered upper portion thereof;

a sand trap shoulder provided on the shaft at a location thereon above both the neck portion of the shaft and the upper chambered portion of the cup, said sand trap shoulder spanning circumferentially around the shaft and imparting a localized increase of external diameter to the shaft relative to neighbouring areas thereof immediately above and below the sand trap shoulder to hinder passage of sand, situated outside the shaft, from above the sand strap shoulder downwardly therepast toward the plunger; and angled cleanout ports penetrating an exterior of the peripheral wall of the shaft just above the sand trap shoulder and penetrating an interior of the peripheral wall, into the axial through bore of the shaft, at lesser elevation thereon than where the angled cleanout ports penetrate the exterior of the exterior of the peripheral wall, said angled cleanout ports being operable to flush clean the sand trap shoulder during a downstroke of the downhole pump system;

wherein an outer diameter of the sand trap shoulder of the shaft is less than an outer diameter of the cup so that the sand trap shoulder denotes a partial sand trap effective to capture a first fractional portion of said sand, while permitting a second fractional portion of said sand to pass downwardly past the sand trap shoulder to the cup, where the second fractional portion of said sand capturable by the sand trap annulus at the chambered upper portion of the cup, whereby the sand trap and the cup cooperatively inhibit downward passage of sand to the plunger.

2. The adapter of claim 1 wherein the angled cleanout ports are each smaller in size than each of the one or more sand trap ports.

3. The adapter of claim 1 wherein the angled cleanout ports are provided in greater quantity than the one or more sand trap ports.

4. The adapter of claim 1 wherein the angled cleanout ports are distributed, in a circumferential direction around the shaft, in a more densely spaced distribution than the one or more sand trap ports.

5. The adapter of claim 1 wherein the exterior of the shaft comprises a flared transition beneath the sand trap shoulder that gradually widens theretoward.

6. The adapter of claim 5 wherein said flared transition is concavely contoured.

7. The adapter of claim 1 wherein the shaft comprises additional angled cleanout ports in the neck portion thereof that penetrate the exterior of the peripheral wall inside the hollow upper chamber of the cup, and penetrate the interior of the peripheral wall at an elevation lower than where said additional cleanout ports penetrate the exterior of said peripheral wall.

8. The adapter of claim 7 wherein the additional angled cleanout ports reside below the one or more sand trap ports.

9. The adapter of claim 7 wherein the angled cleanout ports are each smaller in size than each of the one or more sand trap ports.

10. The adapter of claim 7 wherein the additional angled cleanout ports are provided in greater quantity than the one or more sand trap ports.

11. The adapter of claim 7 wherein the additional angled cleanout ports are distributed, in a circumferential direction around the shaft, in a more densely spaced distribution than the one or more sand trap ports.

12. The adapter of claim 7 wherein the additional angled cleanout ports penetrate the exterior of the peripheral wall at, or upwardly adjacent of, a topside of an external abutment shoulder of the shaft that resides at a bottom of the sand trap annulus and abuts against an internal stop shoulder of the cup that is located at a bottom of the hollow upper chamber thereof.

13. The adapter of claim 12 wherein the additional angled cleanout ports penetrate the exterior of the peripheral wall at the topside of the external abutment shoulder, which topside of the external abutment shoulder is beveled.

14. The adapter of claim 12 wherein the shaft reaches downwardly past the internal stop shoulder of the cup.

15. The adapter of claim 10 wherein the additional angled cleanout ports penetrate the exterior of the peripheral wall of the shaft at or adjacent a bottom end of sand trap annulus.

16. The adapter of claim 1 wherein the shaft terminates at a bottom end thereof inside the cup.

17. The adapter of claim 16 wherein the axial through bore of the shaft is upwardly tapered at a lower region thereof adjacent said bottom end of the shaft.

18. The adapter of claim 1 wherein the shaft and the cup are separately embodied but matable components, mated together by threaded engagement of external male threads on the shaft and internal female threads on the cup, at a location below the chambered upper portion of the cup.

19. The adapter of claim 1 in combination with the plunger and a top connector, of which the top connector is coupled, or adapted for coupling to, the rod of the downhole pump assembly, and the upper coupling portion of the shaft is coupled, or adapted for coupling to, the top connector for indirect connection of the shaft to the top connector through said adapter.

20. The adapter claim 1 characterized, at least between the top end of the cup and the sand trap shoulder, by lack of any means for sealed sliding contact with a pump barrel of the downhole pump for uninhibited admission of the second fraction of sand into the open annulus between the neck portion of the shaft and the chambered upper portion of the cup.

* * * * *